United States Patent [19]

Cox

[11] Patent Number: 4,882,077

[45] Date of Patent: Nov. 21, 1989

[54] METALWORKING FLUID

[75] Inventor: Charles K. Cox, Lansing, Ill.

[73] Assignee: W. R. Grace & Co.-Conn., Lexington, Mass.

[21] Appl. No.: 165,853

[22] Filed: Mar. 9, 1988

[51] Int. Cl.[4] ..... C10M 173/00; B21B 45/02

[52] U.S. Cl. ..... 252/49.5; 252/56 R; 72/42

[58] Field of Search ..... 252/49.5; 72/42

[56] References Cited

U.S. PATENT DOCUMENTS

| | | | |
|---|---|---|---|
| 3,117,929 | 1/1964 | McCoy et al. | 252/49.5 |
| 3,236,778 | 2/1966 | McIntosh | 252/49.5 |
| 3,657,126 | 4/1972 | Sawyer | 252/49.5 |
| 3,726,799 | 4/1973 | McDole et al. | 252/49.5 |
| 3,810,836 | 5/1974 | Norton | 252/49.5 |
| 3,840,462 | 10/1974 | Gerefschlager | 252/34.7 |
| 3,909,429 | 9/1975 | McClaflin | 252/57 |
| 3,981,808 | 9/1976 | McClaflin et al. | 72/42 |
| 4,107,060 | 8/1978 | Schick et al. | 252/49.5 |
| 4,185,485 | 1/1980 | Schick et al. | 72/42 |
| 4,374,168 | 2/1983 | Wojtowicz | 252/9 |
| 4,403,490 | 9/1983 | Sargent | 72/42 |
| 4,411,145 | 10/1983 | Lewis et al. | 72/42 |
| 4,416,132 | 11/1983 | Sargent | 72/42 |
| 4,632,770 | 1/1986 | Slanker | 252/49.5 |

FOREIGN PATENT DOCUMENTS

| | | |
|---|---|---|
| 925966 | 2/1962 | United Kingdom . |
| 1369515 | 2/1972 | United Kingdom . |

OTHER PUBLICATIONS

Smalheer & Smith; "Lubricating Additives", 1967.

Norpar ®—High-Purity Normal Paraffinic Solvents, Mar. 30, 1983, Exxon Corporation.

Abstract, vol. 18, No. 198, Jun. 8, 1988 of Japanese Patent Application No. 61-143181.

*Primary Examiner*—William R. Dixon, Jr.

*Assistant Examiner*—E. McAvoy

*Attorney, Agent, or Firm*—John Dana Hubbard; William L. Baker

[57] ABSTRACT

A metalworking fluid comprising three constituents, a highly purified paraffin oil, one or more esters, and an emulsifier. The metalworking fluid may be used in its neat form or may be diluted with water such that the water component is from about 50% to 99% by volume of the total volume of water and metalworking fluid. The metalworking fluid provides excellent lubricating and cooling properties while avoiding any off taste problems.

6 Claims, No Drawings

METALWORKING FLUID

The present invention relates to metalworking fluids and more particularly oil-in-water emulsified metalworking fluids with excellent lubrication, cooling and taste properties.

BACKGROUND OF THE INVENTION

Traditional metal containers, such as food and beverage cans, are known as three piece cans. These cans were formed of three separate components; a sidewall which is formed by bending a flat sheet of metal into a cylindrical shape and applying a weld along the seam to retain that shape; a top end and a bottom end. While successful, these three piece cans were slow to manufacture and contained several potential sources of leakage (side seam and top and bottom ends).

In the past decade, a new container design has been replacing the traditional three piece can. This new design is known as the "two piece can". A two piece can is formed from a first piece which is worked so as to form a unitary sidewall and bottom and a second piece which forms the top end of the container. This design eliminates several potential sources of leakage, allows for the entire surface to be printed and reduces the amount of metal used in the formation of the container.

Two piece cans are generally formed of either tin plated steel or more preferably aluminum.

The process for forming the two piece containers is known as the "drawing and ironing" process. In the drawing step, a flat sheet of metal is formed into a shallow cuplike piece similar in appearance to a petri dish. This cup is then placed into an ironer which has an outer die shaped to reflect the desired outer dimensions of the container and an inner, moveable punch configured to match the desired inner dimensions of the container. The punch is moved against the bottom of the cup one or more times to lengthen the cup, reduce its wall thickness and form it into the desired shape.

During the drawing and ironing steps, a metalworking fluid is required to prevent rupturing of the metal and to prevent the metal from sticking to the tooling. More particularly, a metalworking fluid primarily having lubricating properties is required during the drawing process and a metalworking fluid having primarily cooling properties is required for the ironing process. Various metalworking fluids have been used in these processes. However, most of these fluids are useful on one of the two process steps but not both, thereby requiring the use of two different fluids which require the use of separate sump collectors and waste treatment systems.

Additionally and perhaps more importantly, the current metalworking fluids tend to leave a residue on the tooling and container surface. The buildup of the residue on the tooling reduces the life of the tooling, causes streaking of the metal surface and increases downtime of the machines for cleaning. The residue left on the container surface cannot be completely removed by a post formation washing process. The residue that remains is thought to bond with the metal surface. It is believed that this remaining residue interacts with the contents of the container to create an off taste in the product. This problem is particularly serious in beer where the residue gives the beer an old or stale taste.

The present invention overcomes the shortcomings of the present metalworking fluids by providing a metalworking fluid that is useful in both the drawing and ironing processes and creates little, if any, formation of residue upon the tooling and container.

SUMMARY AND OBJECTS OF THE INVENTION

The present invention relates to a metalworking fluid containing a highly fractioned paraffin oil with a high content of normal paraffins (at least 98% by mass and a low aromatic content (less than 1%); one or more esters and an emulsifier for the oil and esters. The metalworking fluid may be diluted with water to form an oil-in-water emulsion.

It is an object of the present invention to provide a metalworking fluid comprising a paraffin oil, having a normal paraffin content of at least 98% by mass, an aromatic content of less than 1%, and a flash point of from about 65° C. to about 120° C., one or more esters and an emulsifier capable of forming a stable oil-in-water emulsion.

Another object of the present invention is to provide a metalworking fluid comprised of a paraffin oil wherein the paraffin oil has a normal paraffin content of at least 98% by mass, an aromatic content of less than 1%, and a flash point of from about 65° C. to about 120° C. one or more esters, an emulsifier, a pH buffering agent and a corrosion inhibitor.

A further object of the present invention is to provide a metalworking fluid that prevents the buildup of residue on tooling and the metal being worked and which avoids the formation of off tastes in containers formed with the metalworking fluid.

Another object of the present invention is to provide a water dilutable, oil-in-water emulsion metalworking fluid comprising from about 50 to about 300 parts by weight of a highly purified paraffin oil having a normal paraffin content of at least 98% by mass, an aromatic content of less than 1% and a flash point of from about 64° C. to about 120° C. from about 50 to about 300 parts by weight of one or more esters, and from about 50 to about 70 parts by weight of an emulsifier having an HLB number of from about 6 to about 10.

An additional object of the present invention is to provide a metalworking process comprising the steps of forming a metalworking fluid of a paraffin oil having a normal paraffin content of at least 98% by mass, an aromatic content of less than 1% and a flash point of from about 65° C. to about 120° C., one or more esters, and an emulsifier, applying the metalworking fluid to the metal to be worked and working the metal.

An object of the present invention is to provide a metalworking fluid comprised of a blend of a paraffin oil having a normal paraffin content of at least 98% by mass, an aromatic content of less than 1%, and a flash point of from about 65° C. to about 120° C., one or more esters and an emulsifier, the blend being diluted in a volume of water such that the blend comprises from about 1% to about 50% by volume of the total volume of blend and water.

These and other objects will be readily discernible to one skilled in the art from the following preferred embodiments and appended claims.

DETAILED DESCRIPTION OF THE PREFERRED EMBODIMENTS

It has been known to use highly purified paraffin oils (i.e. a normal paraffin content of at least 98% by mass and an aromatic content of less than 1%) as rolling oils in the cold rolling of aluminum. These oils are desirable in that they are highly purified and inert and therefore do not interfere with the preparation of the aluminum, nor bind to the aluminum surface and create an off taste.

These oils, however, have not been used in other metalworking applications where their purity and inertness would be useful because they lack the required lubricity, cooling and emulsifying properties necessary for metalworking. In particular, these oils have very low viscosities and limited inherent lubrication properties which hinder their use as metalworking fluids. Likewise, these oils have proven to be difficult to emulsify in water and do not provide stable emulsions.

The present invention provides a means by which these oils can be successfully incorporated into a metalworking fluid while exhibiting excellent lubricity and cooling properties and forming stable emulsions in water.

The metalworking fluid of the present invention contains three major constituents, the paraffinic oil, one or more esters and an emulsifier for the oil and esters when placed in water. Other common metalworking fluid constituents may also be added, if desired.

The fluid is made in concentrate form, i.e. without the addition of water. The fluid may be used in its neat form or it may be diluted to a lesser concentration with water, if so desired.

The concentrate preferably will have a viscosity of from about 30 to about 100 (SUS at 100° F.) and a pH of from about 8 to about 10.5, more preferably from about 8.5 to 9.5.

The paraffin oils used in the present invention comprise highly fractionated, purified oils with a high content of normal paraffins (about 98% by mass), a narrow range of normal paraffins, e.g. a range of 4 carbon atoms or less from $C_{10}$ to $C_{18}$, an aromatic content of less than 1%, a narrow boiling range and a flash point of from about 65° C. to about 120° C. Such oils are commercially available from the Exxon Corporation under the trademark, NORPAR® paraffin oils and solvents.

One example of a suitable paraffin oil has a normal paraffin range of from $C_{10}$ to $C_{12}$ (98% by mass), an aromatic content of less than 1%, and a flash point of 69° C. and is sold under the tradename "NORPAR®12" by the Exxon Corporation. The amount of oil used in the present invention can range from about 50 parts by weight to about 300 parts by weight. Preferably, the amount used is from about 150 parts to about 225 parts by weight, most preferably about 200 parts by weight.

Such oils are desired in that they do not impart any flavor to the product on which they are used.

The second constituent of the metalworking fluid is one or more esters. The ester or esters provide additional lubrication properties to the metalworking fluid. Further, the ester or esters are included to modify the viscosity of the metalworking fluid. As the paraffin oil and emulsifier generally have a low viscosity, i.e. below the desired range of from about 30 to 100 (SUS at 10° F.), the selected ester or esters should have a viscosity sufficiently high so as to increase the viscosity of the metalworking fluid into the desired range. Preferably, the ester or esters selected should have a viscosity of at least about 100 (SUS at 100° F.). Such esters are well known and commercially available.

The preferred esters are formed from a $C_6$ to $C_{20}$ acid, either monobasic or dibasic and a $C_6$ to $C_{20}$ primary, secondary or tertiary alcohol or blend of such alcohols.

The more preferred esters are formed from $C_6$ to $C_{16}$ acids.

Esters based upon $C_{18}$ fatty acids may result in flavor problems if they contain linoleates. It is preferred to avoid the use of such esters unless either off taste problems are not a concern or sampling of the finished product has indicated that no off taste is likely to occur.

Suitable acids that can be used to make the preferred diesters include, for example, adipic, azaleic and other dibasic acids.

The preferred alcohols used in forming the esters useful in the present invention are a blend of $C_6$ to $C_{20}$ alcohol byproducts from the oxo process.

Examples of suitable esters that may be used in the present invention, include but are not limited to SMITHOL-50, SMITHOL-52W, and SMITHOL-76-1000, all available from Werner G. Smith, Inc.

The third constituent of the metalworking fluid is an emulsifier.

While any oil-in-water emulsifier may be used in the present invention, it is desirable that the emulsifier be either anionic or nonionic in nature. The selected emulsifier preferably will have an HLB number of from about 6 to about 10 with a more preferred HLB number of about 7.5.

It is noted that a HLB number is generally associated with nonionic emulsifiers as the HLB numbers of other emulsifiers, especially ionic emulsifiers, do not accurately correlate to the weight percentage of hydrophilic and lipophilic constituents. However, an appropriate HLB number for such emulsifiers can be determined experimentally and are generally included in the product literature.

The selected emulsifier should completely emulsify the other constituents of the concentrate when mixed with water. The emulsifier should also be capable of maintaining a stable emulsion during use.

The amount of emulsifier used in the concentrate should be from about 70 parts by weight to about 100 parts by weight of the concentrate.

A preferred nonionic emulsifier in the present invention is known by the trade name MASLIP 100, provided by Mazer Chemical and is believed to be a linear alcohol capped with a fatty acid.

A preferred anionic emulsifier is an ethoxylated fatty acid type emulsifier commercially available as MAZOL 160 from Mazer Chemical.

Other conventional metalworking fluid additives may be added so long as they do not adversely affect the emulsion stability or taste characteristics of the fluid. Such additives include pH buffering agents and corrosion inhibitors.

The pH buffering agent is especially useful in maintaining the pH level of the emulsion above 8.0, preferably above 8.5. Suitable pH buffering agents are well known and include, but are not limited, to various amines such as ethanolamines, diethanolamines, triethanolamines and borated amines. The preferred buffering agent is a borated amine. The amount of pH buffering agent is preferably from about 1 to about 15 parts by weight, most preferably about 10 parts by weight.

Suitable corrosion inhibitors may be used in the present invention. Such inhibitors are generally proprietary products and are known only by their commercial trade names. Suitable inhibitors for use in the present invention include for example, MAZON RI 198-63B, MAZON RI 239-2 and MAZON RI 37, all proprietary blends available from Mazer Chemical. Other suitable corrosion inhibitors would be obvious to one skilled in the art and are commercially available.

The amount of corrosion inhibitor is generally from about 5 to about 50 parts by weight, more preferably from about 15 to about 30 parts by weight and most preferably about 20 parts by weight.

The concentrate may be formed in any conventional manner such as adding all of the ingredients simultaneously and mixing them until a completely blended liquid is formed. However, it is preferred to add the emulsifier to a large mixer and slowly add the one or more esters and the paraffin oil until the ingredients are fully blended. Lastly, any other ingredients such as a pH buffering agent and corrosion inhibitor are added and thoroughly mixed into a homogeneous, stable blend. The concentrate is then decanted into containers for storage and shipment.

The metalworking fluid may be used in its neat form, i.e. as a concentrate or it may be diluted.

Preferably, the metalworking fluid is diluted with water such that the amount of concentrate is from about 1% to 50% by volume of the total volume of the water and concentrate.

For example, where lubricity properties are most desired, less water is used so that there is more oil and esters present. However, where cooling properties are most desired, such as in the ironing process, the volume of water is greater than the volume of concentrated fluid. Generally, where lubricity is primarily required, the amount of water used is about 50% by total volume. Where cooling is primarily required, the amount of water is from about 80% to 99% by total volume.

EXAMPLE 1

A metalworking fluid concentrate of the following formula was mixed together:

200 parts by weight of a paraffin oil, NORPAR® 13;
100 parts by weight of a linear alcohol based emulsifier, MASLIP 100, manufactured by Mazer Chemical,
115 parts by weight of a fatty acid ester supplied by W.G. Smith under the designation SMITHOL 76-1000;
20 parts by weight of a corrosion inhibitor, MAZON RI 198-63B, from Mazer Chemical, and
10 parts by weight of an borated amine.

The concentrate was used in neat form upon a Minster cupper and at a 5% concentration upon an ironer. The aluminum was a 3004-H19 alloy, 0.013 inch thick. The cans were found to be acceptable and the tooling to be clean (i.e. no discernible aluminum oxide, oil, etc. on the tooling). The same concentrate (neat) was also tested on a Flexo cupping press at 150 cups per minute and at a 5% concentration on a Reynolds Mark III bodymaker for eight hours. The aluminum used was a 3105-H19 alloy, 0.0128 inches thick. After eight hours, the tooling was found to have a minimal build up of debris and the cans were found to be acceptable.

While this invention has been discussed in the light of its preferred embodiments, i.e. as a metalworking fluid for two piece cans, it is by no means meant to be so limited. The metalworking fluid of the present invention may also be used in a cold rolling process of metal, especially metal destined to be used by the container industry. Further, it may be used in any metalworking operation where its properties would be useful. Examples of such metalworking operations include but are not limited to grinding, machining and cutting.

Further, while this invention has been described with reference to its preferred embodiments, other embodiments can achieve the same results. Variations and modifications of the present invention will be obvious to those skilled in the art and it is intended to cover in the appended claims all such modifications and equivalents as fall within the true spirit and scope of this invention.

What I claim is:

1. A method of metalworking comprising the steps of:

(a.) applying to a metal surface a metalworking fluid composition comprising from about 50 to about 300 parts by weight of a paraffin oil having a normal paraffin content of at least 98% by mass, an aromatic content of less than 1% and a flash point of from about 65° to about 120° C., from about 50 to about 300 parts by weight of one or more esters, and from about 70 to about 100 parts by weight of an emulsifier having an HLB number of from about 6 to about 10; and (b.) performing a metalworking operation on the metal surface.

2. The method of claim 1 wherein the one or more esters are selected from the group consisting of acid esters; and the emulsifier is selected from the group consisting of anionic and nonionic emulsifiers.

3. The method of claim 1 wherein the metal surface is selected from the group consisting of steel and aluminum.

4. A method of drawing and ironing a two piece can comprising the step of:

(a.) applying a metalworking fluid to a metal surface, the fluid comprising a paraffin oil having a normal paraffin content of at least about 98% by mass, an aromatic content of less than 1% and a flash point of from about 65° C. to about 120° C., one or more esters and an emulsifier, said fluid being diluted in an amount of water such that the fluid is about 50% by volume of the total volume of fluid and water;

(b.) subjecting the metal to a drawing process;

(c.) removing the drawn metal;

(d.) diluting a portion of the metalworking fluid of (a) with an amount of water such that the volume of fluid is from about 1% to about 20% by volume of the total volume of fluid and the water, (e.) applying the fluid of (d) to the drawn metal and (f.) subjecting the drawn metal to an ironing process.

5. The method of claim 4 wherein the one or more esters are selected from the group consisting of acid esters formed from $C_6$ to $C_{20}$ acids and $C_6$ to $C_{20}$ alcohols; and the emulsifier is selected from the group consisting of anionic and nonionic surfactants having an HLB number of from about 6 to about 10.

6. The method of claim 4 wherein the paraffin oil is from about 50 to about 300 parts by weight, the one or more esters is from about 50 to about 300 parts by weight and the emulsifier is from about 70 to about 100 parts by weight.

* * * * *